US007481333B2

(12) United States Patent
Goldberg et al.

(10) Patent No.: US 7,481,333 B2
(45) Date of Patent: Jan. 27, 2009

(54) PROPELLANT ACTUATED DUAL FLUID CARTRIDGE

(75) Inventors: Marc A. Goldberg, Kinnelon, NJ (US); Curt Metzbower, Washington Crossing, PA (US); Peter Ngu, East Windsor, NJ (US); Robert W. Springhorn, Cream Ridge, NJ (US)

(73) Assignee: Nordson Corporation, Westlake, OH (US)

( * ) Notice: Subject to any disclaimer, the term of this patent is extended or adjusted under 35 U.S.C. 154(b) by 129 days.

(21) Appl. No.: 11/725,304

(22) Filed: Mar. 19, 2007

(65) Prior Publication Data

US 2007/0246482 A1 Oct. 25, 2007

Related U.S. Application Data

(60) Provisional application No. 60/784,137, filed on Mar. 20, 2006.

(51) Int. Cl.
*B67D 5/56* (2006.01)
*B67D 5/52* (2006.01)
*B67D 5/60* (2006.01)
*B65D 83/00* (2006.01)

(52) U.S. Cl. ..... 222/135; 222/1; 222/145.1; 222/145.5; 222/389; 222/137

(58) Field of Classification Search ..... 222/1, 222/135, 137, 145.1, 145.6, 399, 129, 325, 222/327, 386, 389, 145.5
See application file for complete search history.

(56) References Cited

U.S. PATENT DOCUMENTS 2,754,490 A 7/1956 Cohen
3,370,754 A 2/1968 Cook et al.
3,380,451 A 4/1968 Porter et al.
3,437,242 A 4/1969 Poltras
3,477,431 A 11/1969 Walecka
3,595,439 A 7/1971 Newby et al.
3,678,931 A 7/1972 Cohen
3,682,174 A 8/1972 Cohen
3,684,136 A 8/1972 Maumann
3,760,503 A 9/1973 Baskas
3,885,710 A 5/1975 Cohen
4,014,463 A 3/1977 Hermann
4,029,236 A 6/1977 Carson et al.
4,159,570 A 7/1979 Baskas et al.
4,469,252 A * 9/1984 Obrist ..... 222/135
4,538,920 A 9/1985 Drake (Continued)

FOREIGN PATENT DOCUMENTS

DE 19744746 4/1999

(Continued)

OTHER PUBLICATIONS

M. Eberwein, "European Search Report", Aug. 19, 2005, 3 pages.

(Continued)

*Primary Examiner*—Kevin P Shaver
*Assistant Examiner*—Melvin A Cartagena
(74) *Attorney, Agent, or Firm*—Wood, Herron & Evans, L.L.P.

(57) ABSTRACT

A propellant actuated dual fluid cartridge which does not need a separate dispensing mechanism is disclosed.

16 Claims, 8 Drawing Sheets

U.S. PATENT DOCUMENTS

| | | | | |
|---|---|---|---|---|
| 4,648,532 | A | | 3/1987 | Green |
| 4,771,919 | A | | 9/1988 | Ernst |
| 4,941,751 | A | | 7/1990 | Muhbauer |
| 4,969,747 | A | | 11/1990 | Colin et al. |
| 4,986,443 | A | | 1/1991 | Saur et al. |
| 5,058,770 | A | | 10/1991 | Harold et al. |
| 5,172,807 | A | | 12/1992 | Dragon et al. |
| 5,310,091 | A | | 5/1994 | Dunning et al. |
| 5,746,354 | A | * | 5/1998 | Perkins ..... 222/132 |
| 6,048,201 | A | | 4/2000 | Zwingenberger |
| 6,116,900 | A | | 9/2000 | Oster |
| 6,328,715 | B1 | | 12/2001 | Dragon et al. |
| 6,398,761 | B1 | | 6/2002 | Bills et al. |
| 6,454,129 | B1 | | 9/2002 | Green |
| 6,634,524 | B1 | | 10/2003 | Helmerstein |
| 6,652,494 | B1 | | 11/2003 | Dragon et al. |
| 6,843,652 | B2 | | 1/2005 | Xie et al. |
| 6,848,480 | B2 | | 2/2005 | Brennan |
| 6,869,419 | B2 | | 3/2005 | Dragon et al. |

FOREIGN PATENT DOCUMENTS

| | | |
|---|---|---|
| DE | 10132417 | 1/2003 |
| FR | 2418173 | 9/1979 |
| WO | WO03050012 | 6/2003 |
| WO | WO2005005305 | 1/2005 |

OTHER PUBLICATIONS

D. Jelercic, "European Search Report", Apr. 18, 2006, 3 pages.

* cited by examiner

PROPELLANT ACTUATED DUAL FLUID CARTRIDGE

CROSS-REFERENCE TO RELATED APPLICATIONS

This application claims priority from and claims the benefit of U.S. Provisional Application No. 60/784,137, filed Mar. 20, 2006, entitled "Propellant Actuated Dual Fluid Cartridge", which is hereby incorporated by reference.

BACKGROUND

Dual fluid cartridges are used to store and dispense two fluids which must be kept separate until the time of use and then, at the time of dispensing, need to be mixed together very quickly in a precise pre-set ratio to ensure that the proper chemical reaction takes place. If the cartridge does not dispense the two fluids properly in the required pre-set ratio, the final fluid mixture may be greatly affected and may not function or adhere as required. Examples of such fluids are those that are used to create thermoset adhesives (i.e. a resin and a hardener).

Dual fluid cartridges have been used in industry for the last twenty years and, over the years, differing types of dual fluid cartridges have been developed. An example of a relatively recently developed dual fluid cartridge is the one depicted and described in U.S. Pat. No. 5,310,091, entitled "Dual Product Dispenser", ("'091 Patent") which is commonly owned with this application and is incorporated by reference herein. However, with such prior designs, in order to dispense the fluids within, some means of providing a large force, generally through a mechanism which provides a mechanical advantage (e.g. a caulking gun) or a pneumatic cylinder actuated mechanism, was needed. The required additional dispensing mechanism involves an extra expense and requires the user to take the extra step of loading the cartridge into the mechanism.

These prior dispensing mechanisms and cartridge arrangements have other drawbacks as well. For instance, these other mechanisms are often hard for a user to control. A case in point is with the use of a caulking gun where the handle and trigger assembly is typically eight inches or more away from the point of application, making for a dispensing mechanism that is hard to control. Another drawback of these prior mechanisms is that they generally add weight to the dispensing assembly and still require the user to apply a large amount of force.

Accordingly, there is a need for a dual fluid dispensing cartridge that is self-contained and actuated with a simple trigger that does not need an external dispensing mechanism to dispense the fluids from the cartridge.

SUMMARY

According to one aspect of the present invention, a propellant actuated fluid cartridge for storing and dispensing two fluids includes a can having an opening and having a sealed end opposite the opening. The cartridge also includes a stationary cartridge disposed within the can, wherein the stationary cartridge defines an outlet in communication with the opening formed in the can and a delivery tube disposed within the stationary cartridge and defining an outlet that is co-located with the outlet defined by the stationary cartridge. The cartridge also includes a first piston disposed between the interior of the stationary cartridge and the exterior of the delivery tube forming a fluid chamber for a first fluid, and a moveable cartridge having a closed end and a sidewall, wherein the moveable cartridge is disposed within the stationary cartridge between the first piston and the sealed end of the can and wherein the moveable cartridge sidewall is connected to the first piston and has at least one passageway formed therein. According to this aspect of the present invention, the cartridge also includes a compression wall disposed within the interior of the moveable cartridge between the first piston and the closed end of the moveable cartridge, wherein the compression wall and the moveable cartridge define a second fluid chamber for a second fluid. A propellant is disposed within the can, and a valve is attached to the opening of the can.

DESCRIPTION OF THE DRAWINGS

These and other features, aspects and advantages of the present invention will become better understood with regard to the following description, appended claims and accompanying drawings where:

DETAILED DESCRIPTION

Figure 1:
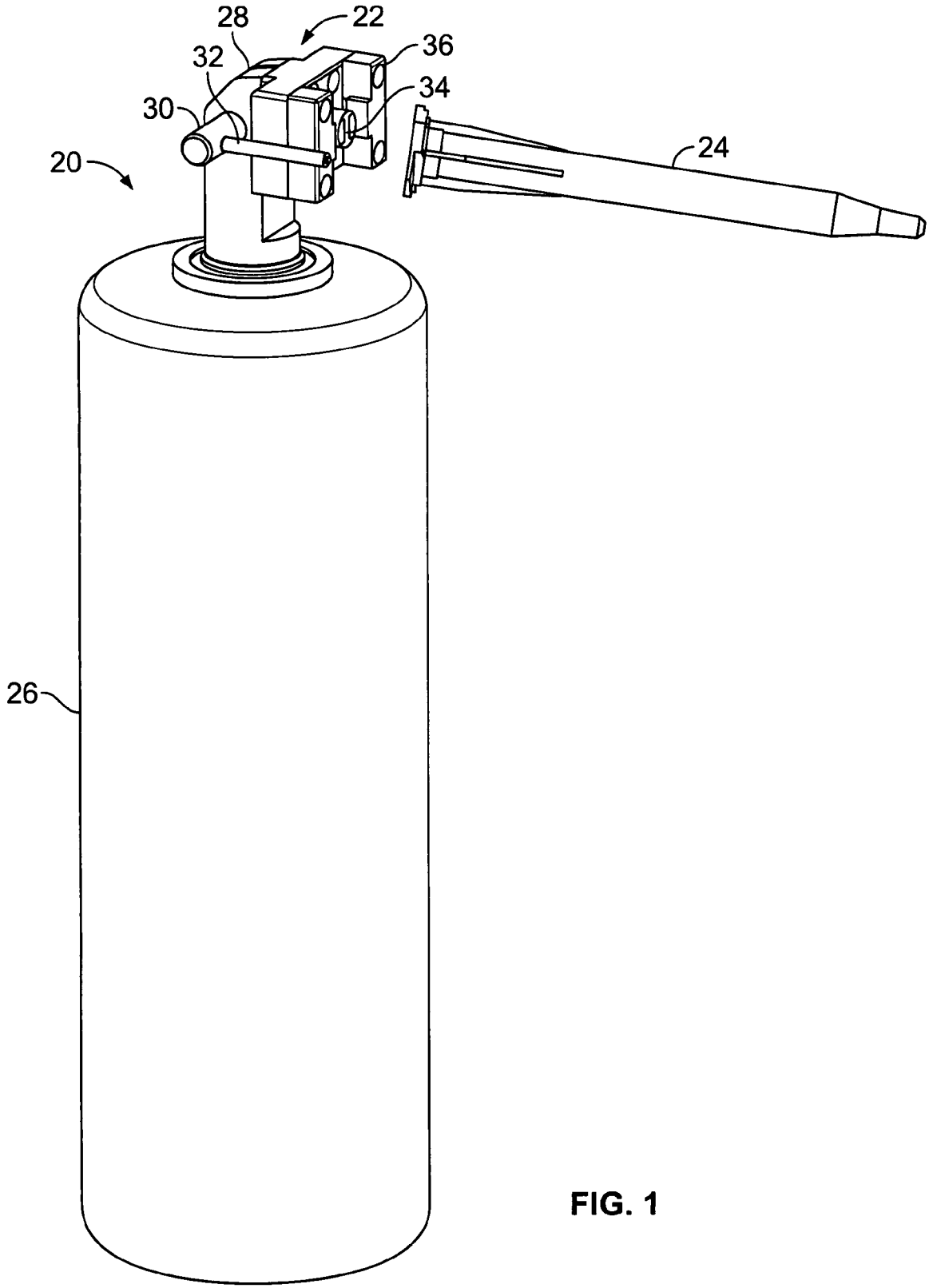
FIG. 1 is a perspective view of an embodiment of a cartridge of the present invention and a static mixer.

Referring to FIG. 1, an embodiment of a propellant actuated dual fluid cartridge 20 of the present invention with a valve 22 attached and a static mixer 24 are depicted. As explained in detail below, the dual fluid cartridge 20 stores two fluids separately from one another until a user is ready to mix the fluids together. Also, as explained below, a propellant may be used to cause the cartridge to actuate. The propellant actuated dual fluid cartridge includes an outer can 26. Valve 22, in this view, is in the closed position and includes a valve body 28, a valve gate 30, a valve trigger 32, a valve two-port outlet 34 and a static mixer connector 36.

Figure 2A:
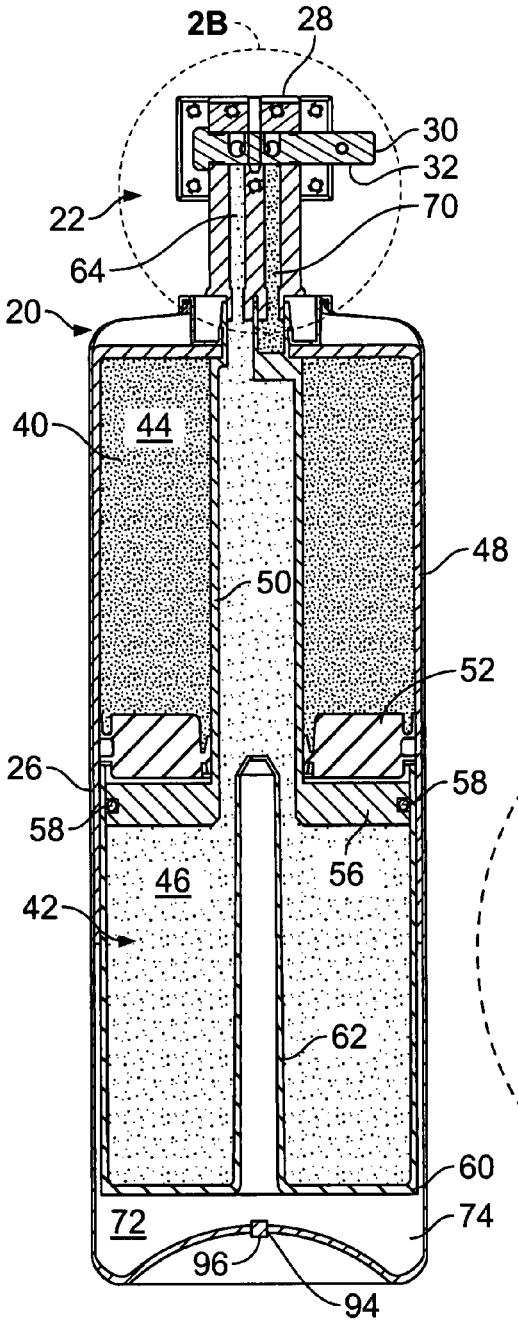
FIG. 2A is a longitudinal cross-sectional view taken along line 2A-2A in FIG. 2 illustrating a filled embodiment of the dual fluid cartridge of the present invention.
Figure 4:
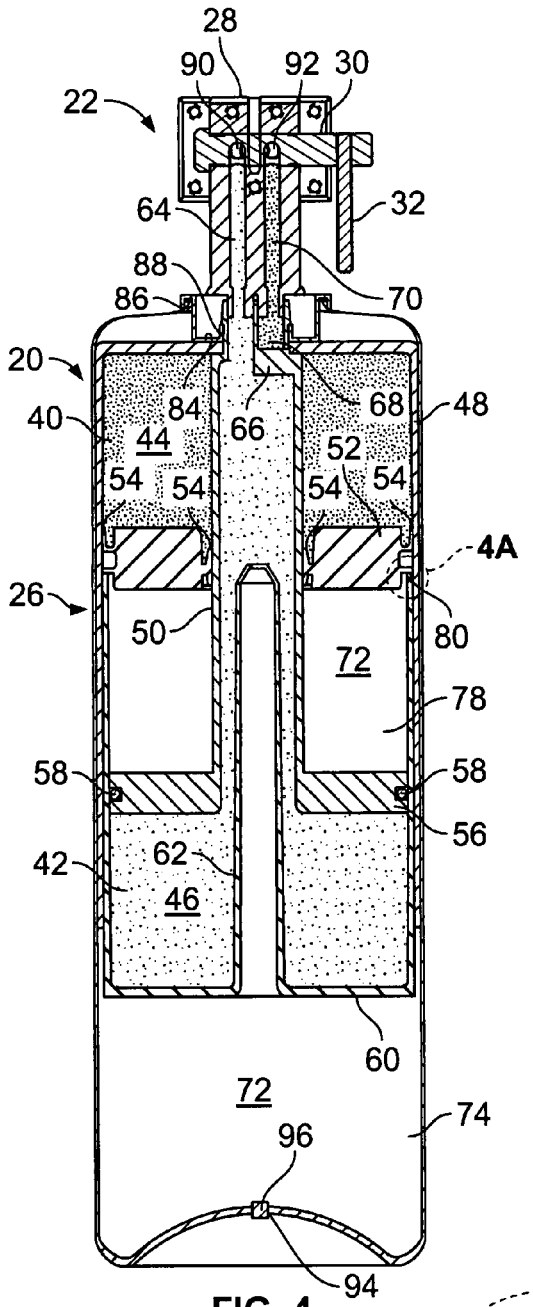
FIG. 4 is a longitudinal cross-sectional view similar to the view in FIG. 3A with the dual fluid cartridge in an intermediate dispensing position.

Referring to FIG. 2A and FIG. 4, longitudinal sectional views of an embodiment of a propellant actuated dual fluid cartridge 20 of the present invention are depicted. FIG. 2A depicts the cartridge 20 in a filled state and FIG. 4 depicts the cartridge in an intermediate dispensing position. In this embodiment of the dual fluid cartridge 20, within the can 26, a first fluid chamber 40 and a second fluid chamber 42 for storing and dispensing a first fluid 44 and second fluid 46 respectively are formed. In this embodiment of the dual fluid cartridge 20, the cartridge 20 includes a stationary cartridge 48, a delivery tube 50, a coaxial piston 52 having a seal (e.g., a lip seal 54 in this embodiment), a compression wall 56 having a seal (e.g., an o-ring 58 in this embodiment) and a moveable cartridge 60 having a post 62 attached thereto. It should be understood that any seals employed in a cartridge 20 of the present invention, such as seals 54, 58, may be any type of seal known in the art. The stationary cartridge 48 in this embodiment is a cylindrical wall defining a hollow interior.

Figure 4A:
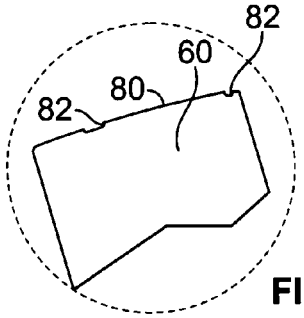
FIG. 4A is an enlarged detail view of the area shown in 4A of FIG. 4 illustrating the passageways formed in the moveable cartridge.

The delivery tube 50 of the cartridge 20 is disposed within the hollow interior of the stationary cartridge 48. The compression wall 56 in this embodiment is formed integral with the delivery tube 50 which fixes the compression wall 56 in place. The delivery tube 50 and the compression wall 56 do not need to be formed integral with one another. The coaxial piston 52 of the dual fluid cartridge 20 is disposed within the cartridge 20 between the exterior of the delivery tube 50 and the interior of the stationary cartridge 48. In this embodiment, the coaxial piston 52 surrounds the exterior of the delivery tube 50. The coaxial piston 52, in conjunction with the exterior of the delivery tube 50 and the interior of the stationary cartridge 48, define the first fluid chamber 40. In this embodiment, the moveable cartridge 60 and the compression wall 56 define the second fluid chamber 42. At an open end 80 of the moveable cartridge 60, passageways 82 (FIG. 4A) are formed in the sidewall of the moveable cartridge 60 in this embodiment. The delivery tube 50 provides fluid communication between the second fluid chamber 42 and a port 64 formed in the valve 22. The delivery tube 50 has a structural wall 66 formed thereon which creates a passageway 68 that allows chamber 40, which contains the first fluid 44, to be in fluid communication with a separate port 70 also formed in the valve 22.

In this embodiment, propellant 72 is stored in an area 74 formed between the bottom surface of the moveable cartridge 60 and the inner surface 76 of the bottom of the can 26. Propellant 72 is able to flow around moveable cartridge 60 and between the outside of moveable cartridge 60 and inside of stationary cartridge 48. The passageways 82 formed at the open end 80 of the moveable cartridge 60 allow propellant 72 to flow into an area 78 defined by the coaxial piston 52, the delivery tube 50, the compression wall 56 and the inside of the moveable cartridge 60.

In this embodiment, propellant 72 is not permitted to flow out of the outer can 26. In this embodiment, a seal configuration common to the aerosol industry is employed to accomplish this. Specifically, a seal 86 is formed between a cup 84 and the can 26. Another seal 88 is formed between the delivery tube 50 and the cup 84, and a seal is formed between the interaction of the stationary cartridge 48 and the delivery tube 50. It should be understood that other sealing configurations may be employed in different embodiments of the invention, such as potentially not forming seals 86, 88 or potentially not using a cup 84, in which case the can 26 would be sealed directly with the components of the dual fluid cartridge interior assembly. In this embodiment, propellant 72 is not permitted to flow into chamber 40 containing the first fluid 44 or chamber 42 containing the second fluid 46. This is facilitated by the seal 88 between the top (i.e. outlet end) of delivery tube 50, the top outlet area of the stationary cartridge 48 and the cup 84.

Figure 2:
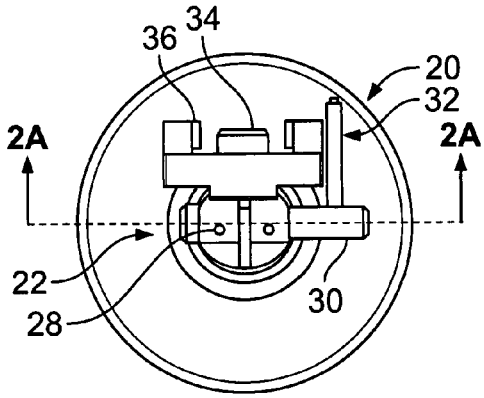
FIG. 2 is a top view of the cartridge depicted in FIG. 1.

Referring specifically to FIG. 2, it can be seen, in this embodiment, that the passageways in the two port outlet 34 of the valve 22 are situated ninety degrees to the longitudinal axis of the propellant actuated cartridge 20. As can be best seen in FIG. 2B, with the valve gate 30 in the closed position as it is in FIG. 1 as well, the ports 64, 70 are effectively blocked off at the valve gate 30. As seen in FIG. 2A, the port 64 is in direct communication with the fluid chamber 42, and the port 70 is in direct communication with the fluid chamber 40.

Figure 3:
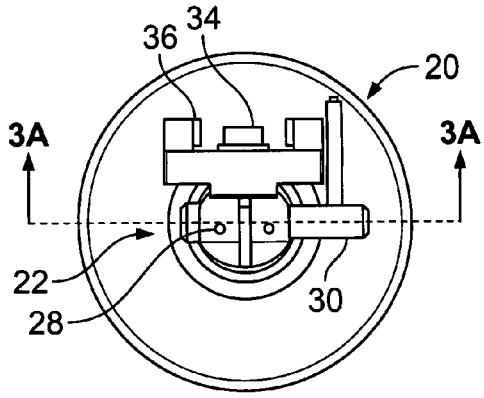
FIG. 3 is a top view of the cartridge depicted in FIG. 1 with the valve rotated into the open position.
Figure 3A:
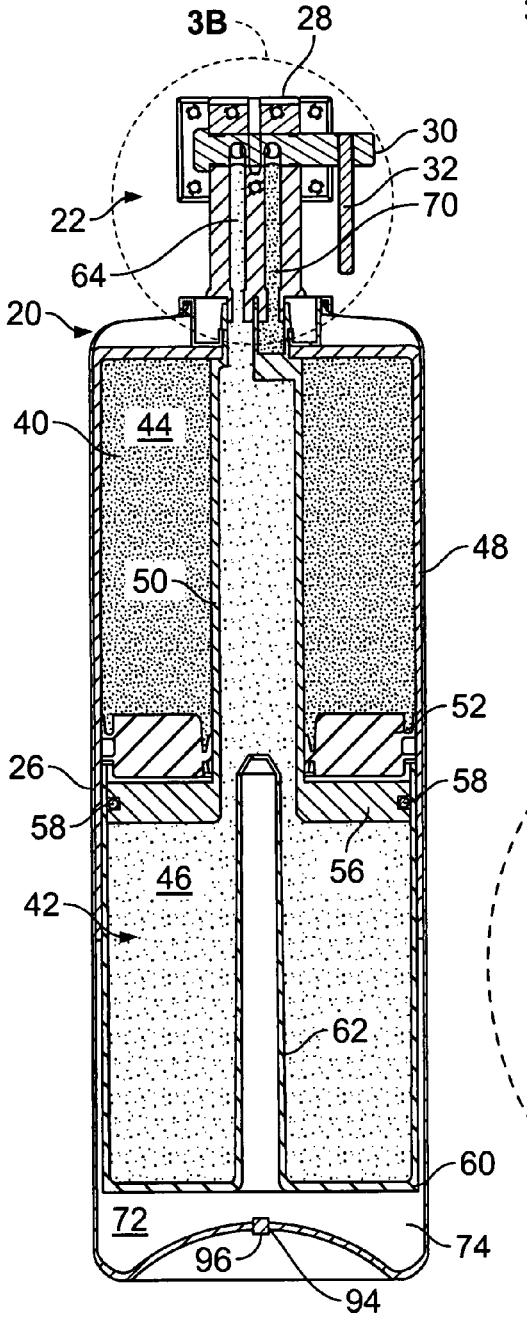
FIG. 3A is a longitudinal cross-sectional view taken along line 3A-3A in FIG. 3 illustrating a filled embodiment of the dual fluid cartridge of the present invention.
Figure 3B:
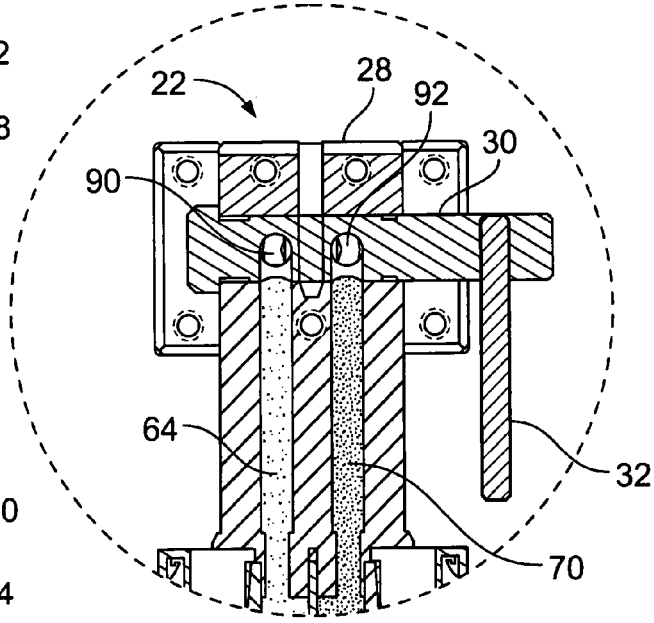
FIG. 3B is an enlarged detail view of the area shown in 3B of FIG. 3A.

FIG. 3 depicts a top view of the propellant actuated dual fluid cartridge 20 with the valve 22 in an open position, which allows the fluids 44, 46 to be dispensed from the cartridge 20. In this embodiment, rotating the valve trigger 32 from the position shown in FIG. 2 clockwise by ninety degrees puts the valve 22 in the open position. As can best be seen in FIG. 3B, with the valve gate 30 in the open position, passageways 90, 92, formed in the valve gate 30, are rotated to be in line with ports 64, 70, respectively. This effectively creates an open passageway between the ports 64, 70 and the passageways of the valve two-port outlet 34. With the passageways of outlet 34 open, the propellant 72, acting in conjunction with the other components of the dispensing cartridge 20, causes the fluids 44, 46 in chambers 40, 42 to flow out of the cartridge 20. Specifically, the expansion of the propellant 72 forces the moveable cartridge 60 and the coaxial piston 52 towards the outlet. The propellant 72 presses on the moveable cartridge 60 and the coaxial piston 52 because it has a known vapor pressure which is greater than the sum of the atmospheric pressure and the friction losses present internal to the assembly, through the valve 22 and the static mixer 24. The pressing of coaxial piston 52 and the moveable cartridge 60 forces fluids 44, 46 out of their chambers 40, 42 into the ports 64, 70. Fluids 44, 46 are then forced into the valve gate passageways 90, 92 and then into the two-port outlet 34 (FIG. 1). Finally, the fluids 44, 46 are forced into and through the static mixer 24 (FIG. 1).

In order to maintain a consistent ratio of the fluids being dispensed, the coaxial piston 52 and the open end 80 of the moveable cartridge 60 are connected together through either plastic welding, a snap fit, or some other common connection means. Connecting the coaxial piston 52 and the moveable cartridge 60 together prevents the coaxial piston 52 and the moveable cartridge 60 from moving independently of one another and keeps the fluids 44, 46 in the chambers 40, 42 dispensing at the same proportional rate. Also, it should be noted that the connection between the coaxial piston 52 and the moveable cartridge 60 is created so that the passageways 82 formed in the open end 60 of the moveable cartridge 60 are not blocked, so that the propellant 72 passes through the passageways 82

Figure 5:
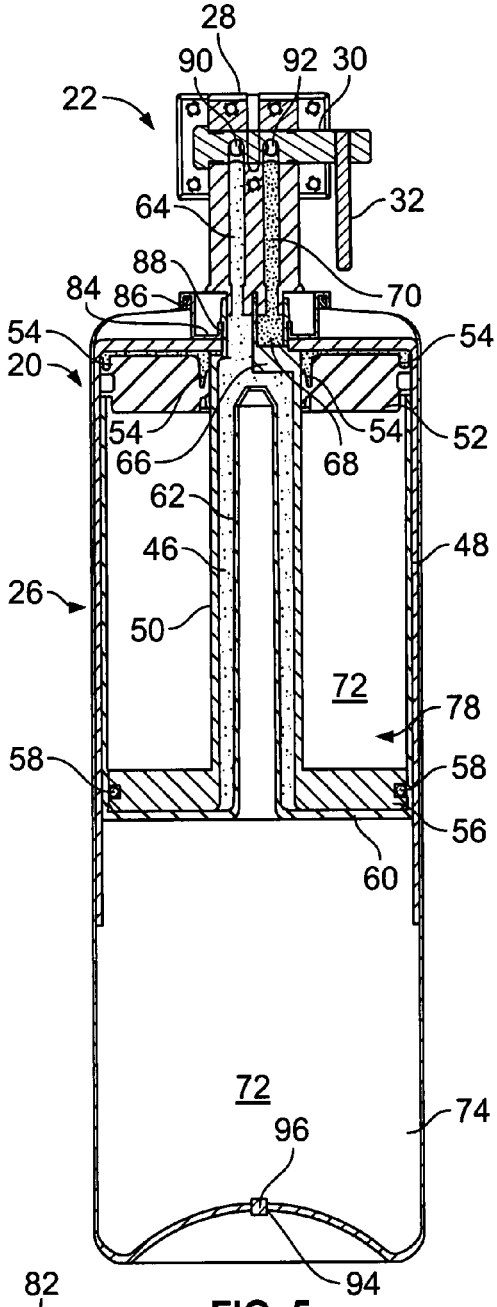
FIG. 5 is a longitudinal cross-sectional view of the dual fluid cartridge depicted in FIG. 3A with the contents of the dual fluid cartridge dispensed.

FIG. 5 depicts the propellant actuated dual fluid cartridge 20 with the useable fluids evacuated. As commonly found in aerosol products, the cartridge 20, in this embodiment, still contains the propellant 72. Also, in this embodiment, small amounts of the fluid 46 are left behind in the port 64 and in the inside area of the delivery tube 50. Methods such as described in commonly owned U.S. patent application Ser. No. 11/031,929 may be employed to minimize remnant fluid 46, which may include modifying the evacuation rod 62 or eliminating the rod 62 all together. In this embodiment, smaller amounts of fluid 44 are left in the port 70.

One embodiment of the cartridge 20 of the present invention may be assembled in the following manner. First, as is commonly done in the aerosol industry with pistons, the dual fluid cartridge interior components are inserted into the outer can 26, in the configuration depicted in FIG. 5, during the outer can 26 manufacturing process. In this embodiment, cup 84 may be attached to outer can 26 and crimped and a seal 86 formed with methods common in the aerosol industry. The dual fluid cartridge interior components, in this embodiment, are then pushed towards the opening in the cup 84 either by a rod pushed through an opening 94 in the can 26 or by using air pressure. With the dual fluid cartridge interior components in place in the cup 84, the cup 84 is crimped and a seal 88 is formed to engage the dual fluid cartridge interior components as depicted. The crimping is accomplished through means similar to those commonly used in the aerosol industry. The dual fluid cartridge components are then filled with the fluids 44, 46 using methods similar to those referred to in commonly owned U.S. Pat. No. 6,848,480 or by use of a vacuum to eliminate air entrapment.

Figure 2B:
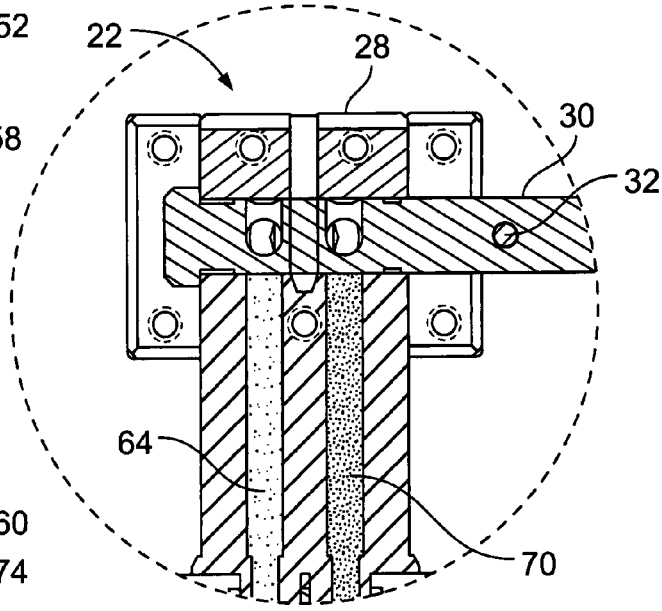
FIG. 2B is an enlarged detail view of the area shown in 2B of FIG. 2A.

Valve 22 is then installed on the can 26 with the ports 64, 70 aligned with and sealed to the outlets of the chambers 40, 42. The valve 22 is placed in the closed position as seen in FIG. 2B. Propellant 72 is then added through the hole 94 in the bottom of the can 26. A rubber plug 96 is put in place to seal the propellant 72 within the can 26, as is common in the aerosol industry.

Figure 6:
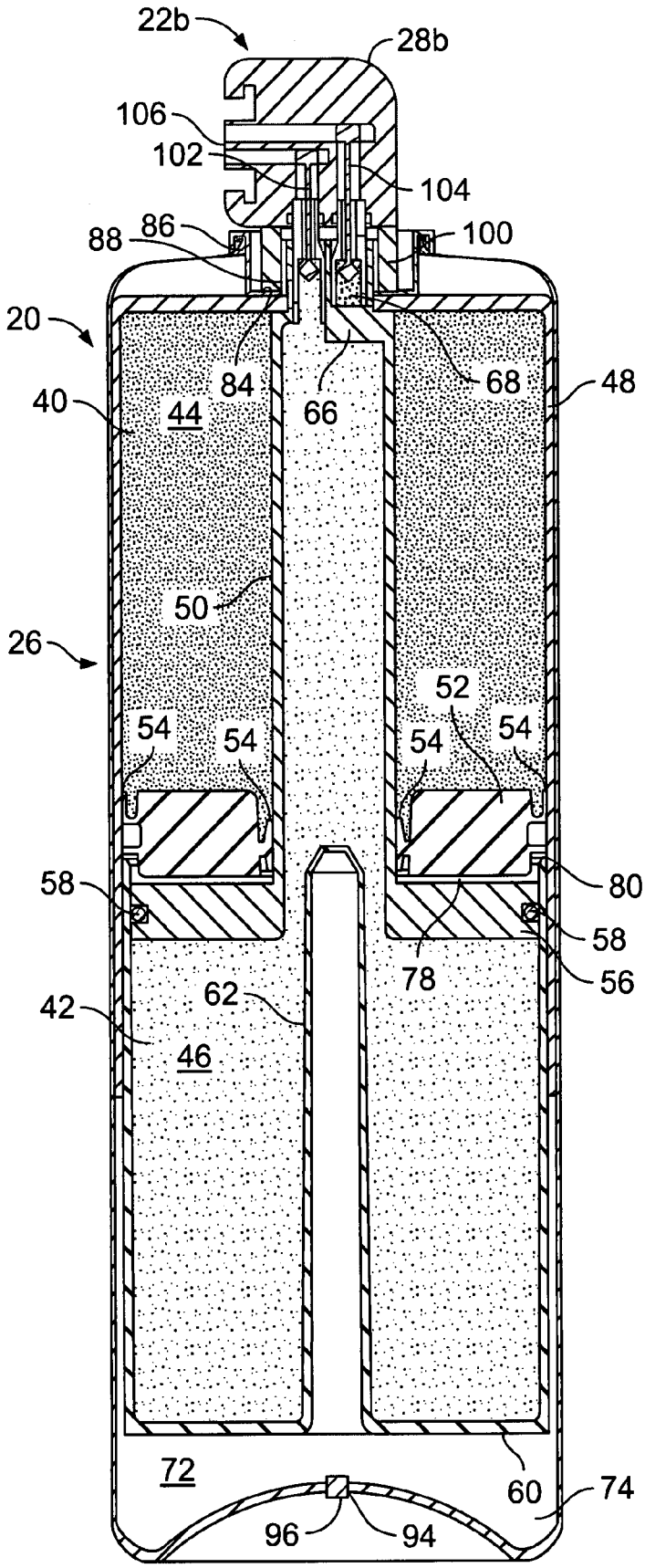
FIG. 6 is a longitudinal cross-sectional view similar to the view in FIG. 3A with an alternate valve mechanism.
Figure 7:
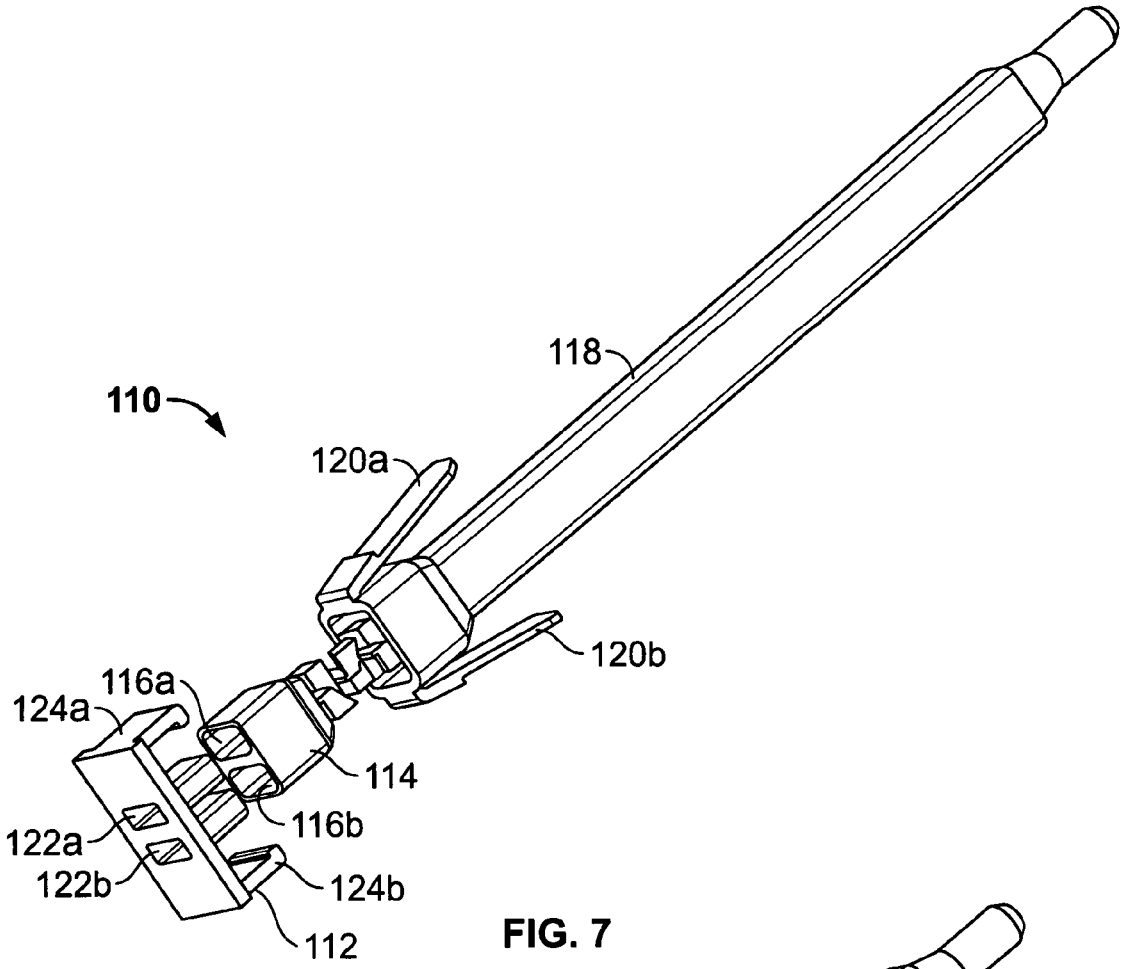
FIG. 7 is an exploded view of an embodiment of a valve and mixer attachment for use with the dual fluid cartridge of the present invention.
Figure 7A:
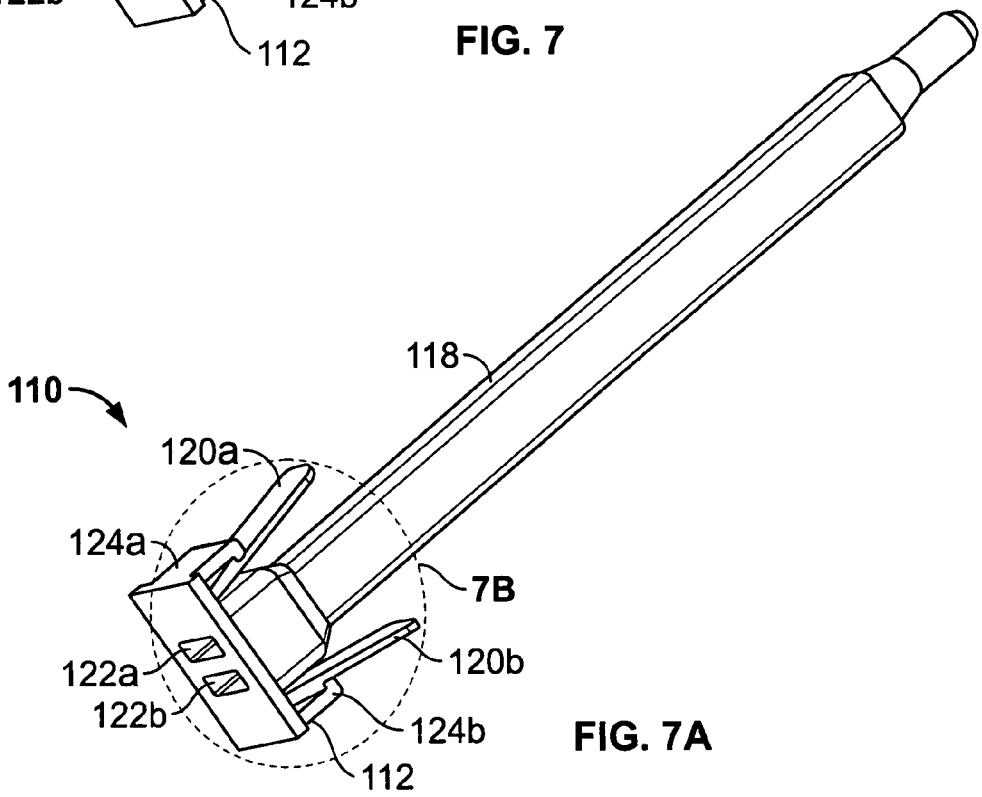
FIG. 7A is an assembled view of the embodiment of the valve and mixer attachment of FIG. 7.
Figure 7B:
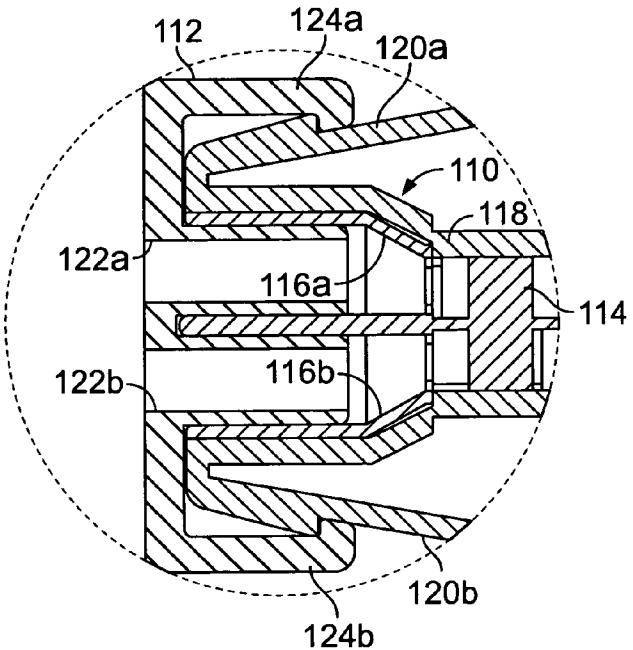
FIG. 7B is an enlarged, cross sectional detail view of the area shown in 7B of FIG. 7A.

FIG. 6 depicts another valve embodiment of the present invention. In this embodiment, the cartridge has a different valve 22*b*. The valve 22*b* of this embodiment is actuated by depressing the valve body 28*b* against a spring 100. Depression of the valve body 28*b* causes a pair of valve stems 102, 104 to open and, in turn, opens the passageways 64, 70, allowing the fluids 44, 46 to dispense through a two-port outlet 106 of the valve 22*b*.

FIGS. 7, 7A, 7B and 8 other valve and mixer attachment embodiments of the present invention. When the fluid components 44, 46 of the cartridge 20 are mixed together, they form the final product. As a result, the mixers 24 used are disposable. A problem arises, however, when the fluids 44, 46 are allowed to intermix at the outlet 34. The final product can form, effectively rendering all of the fluids remaining in the cartridge 20 useless because they cannot be dispensed. The valve and mixer attachment 110 of this embodiment addresses this problem. The valve and mixer attachment 110 includes a valve interface 112 with tab latches 124*a*, 124*b*, a mixer 114 having ports 116*a*, 116*b* and a mixer housing 118 having tabs 120*a*, 120*b*. The valve interface 112 has ports 122*a*, 122*b* formed therein.

Figure 8:
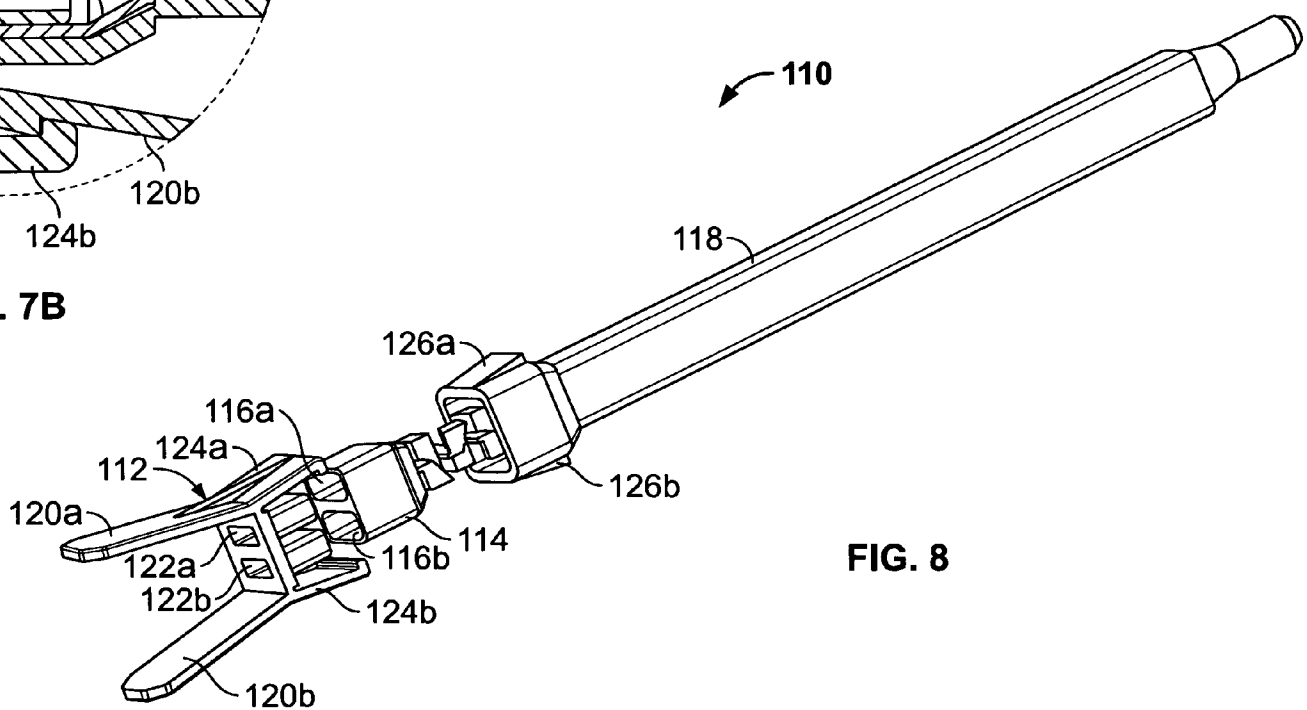
FIG. 8 is an exploded view of an alternate embodiment of a valve and mixer attachment for use with the dual fluid cartridge of the present invention.

To attach the valve and mixer attachment 110 to the valve 22, the valve interface ports 122*a*, 122*b* are lined up with the ports in the outlet 34 and the valve interface 112 is pushed onto the outlet 34. The tabs 120*a*, 120*b* of the mixer housing 118 are snapped into the tab latches 124*a*, 124*b* of the valve interface 112. As part of this process, the ports 116*a*, 116*b* of the mixer 114 are lined up with and attached to the ports 122*a*, 122*b* of the valve interface 112. The tab interface allows for easy removal and replacement of the mixer housing 118 and the enclosed mixer 114. This arrangement also keeps the outlet 34 of the valve 22 clear of the fluids 44, 46 mixing together. As such, the cartridge 20 can be re-used over and over until all of its contents are used. FIG. 8 shows an alternate embodiment where the tabs 120*a*, 120*b* are formed integral with the valve interface 112 and the mixer housing 118 has engagement collars 126*a*, 126*b* that interact with and engage the modified tab latches 124*a*, 124*b* of the valve interface 112.

Figure 9:
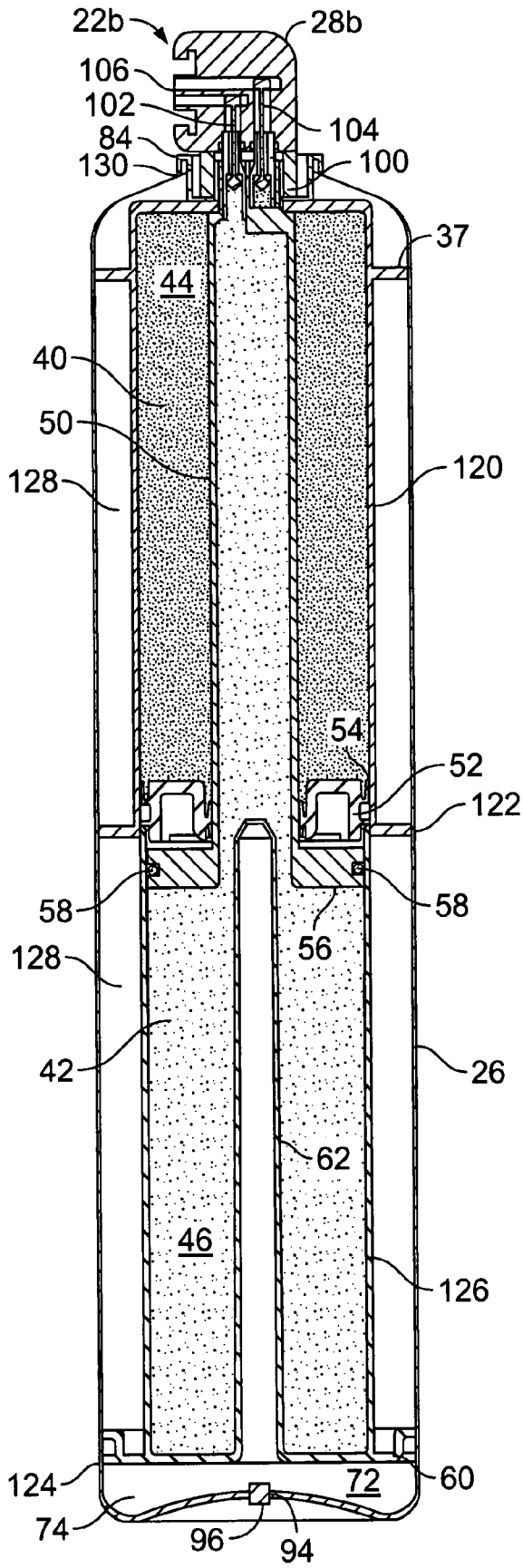
FIG. 9 is a longitudinal cross-sectional view similar to the view in FIG. 6 illustrating an alternate embodiment of the present invention.

FIG. 9 depicts yet another embodiment of the present invention. The valve shown in this embodiment is similar to the valve 22*b* shown in FIG. 6. However, it should be understood that any valve arrangement could be employed, including valve 22 shown in FIG. 2B and other earlier figures. Stationary cartridge 120, in this embodiment, has non-sealing stabilizing rings 122 to ensure central location of the dual fluid cartridge with respect to the outer can 26 and cup 84. In the embodiment in FIG. 9, the propellant 72 is contained in the chamber 74 between a flange 124 formed on the moving cartridge 126 and the bottom 76 of the outer can 26. Areas 128 formed within the can 26 contain ambient air. The areas 128 are in communication with the ambient atmosphere through area 130 which is crimped, but not sealed as it is in the other previously described embodiments.

The pressure of fluids 44, 46 is proportional to the diameter of the flange 124 and the vapor pressure of propellant 72. As with the previously described embodiment, the propellant 72 presses on the moveable cartridge 60 and the coaxial piston 52 because it has a known vapor pressure which is greater than the sum of the atmospheric pressure and the friction losses present internal to the assembly, through the valve 22 and the static mixer 24. As before, the pressing of coaxial piston 52 and the moveable cartridge 60 forces the fluids 44, 46 out of their chambers 40, 42 and into the ports 64, 70. As such, when the valve 22 is opened, fluid flows out of the cartridge.

This system may be used on various ratios of dual fluids. Examples of dual fluid cartridges with ratios other than 1:1 are disclosed in commonly owned U.S. patent application Ser. No. 10/938,328. This cartridge 20 described and claimed herein may be employed using multiple fluids (e.g. more than two).

While the invention has been discussed in terms of certain embodiments, it should be appreciated that the invention is not so limited. The embodiments are explained herein by way of example, and there are numerous modifications, variations and other embodiments that may be employed that would still be within the scope of the present invention.

What is claimed is:

1. A propellant actuated fluid cartridge for storing and dispensing two fluids, comprising:

a can having an opening formed thereon and having a sealed end opposite the opening;

a stationary cartridge disposed within the can, wherein the stationary cartridge defines an outlet in communication with the opening formed in the can;

a delivery tube disposed within the stationary cartridge and defining an outlet that is co-located with the outlet defined by the stationary cartridge;

a first piston disposed between the interior of the stationary cartridge and the exterior of the delivery tube forming a fluid chamber for a first fluid;

a moveable cartridge having a closed end and a sidewall, wherein the moveable cartridge is disposed within the stationary cartridge between the first piston and the sealed end of the can and wherein the moveable cartridge sidewall is connected to the first piston and has at least one passageway formed therein;

a compression wall disposed within the interior of the moveable cartridge between the first piston and the closed end of the moveable cartridge, wherein the compression wall and the moveable cartridge define a second fluid chamber for a second fluid;

a propellant disposed within the can; and a valve attached to the opening of the can.

2. The propellant actuated fluid cartridge of claim 1, wherein the valve is triggered actuated.

3. The propellant actuated fluid cartridge of claim 1, wherein the valve is spring actuated.

4. The propellant actuated fluid cartridge of claim 1, further comprising a mixer attached to the valve.

5. The propellant actuated fluid cartridge of claim 1, further comprising a valve and mixer attachment attached to the valve, wherein the valve and mixer attachment includes a valve interface, a mixer and a mixer housing and the mixer housing and the mixer are detachable from the valve interface.

6. The propellant actuated fluid cartridge of claim 1, wherein the delivery tube is formed integral with the compression wall.

7. A propellant actuated fluid cartridge for storing and dispensing two fluids, comprising:

a can having an opening formed thereon and having a sealed end opposite the opening;

a stationary cartridge disposed within the can, wherein the stationary cartridge defines an outlet in communication with the opening formed in the can;

a delivery tube disposed within the stationary cartridge and defining an outlet that is co-located with the outlet defined by the stationary cartridge;

a first piston disposed between the interior of the stationary cartridge and the exterior of the delivery tube forming a fluid chamber for a first fluid;

a moveable cartridge having a closed end and a sidewall, wherein the moveable cartridge is disposed within the stationary cartridge between the first piston and the sealed end of the can and wherein the moveable cartridge sidewall is connected to the first piston and has at least one passageway formed therein;

a compression wall disposed within the interior of the moveable cartridge between the first piston and the closed end of the moveable cartridge, wherein the compression wall and the moveable cartridge define a second fluid chamber for a second fluid;

a propellant disposed within the can; and a cap attached to the can and covering the opening of the can.

8. A propellant actuated fluid cartridge for storing and dispensing two fluids, comprising:

a can having an opening formed thereon open to atmosphere and having a sealed end opposite the opening;

a stationary cartridge disposed within the can, wherein the stationary cartridge defines an outlet in communication with the opening formed in the can;

a delivery tube disposed within the stationary cartridge and defining an outlet that is co-located with the outlet defined by the stationary cartridge;

a first piston disposed between the interior of the stationary cartridge and the exterior of the delivery tube forming a fluid chamber for a first fluid;

a moveable cartridge having a closed end with a flange extending outward therefrom, wherein the moveable cartridge is disposed within the stationary cartridge between the first piston and the sealed end of the can and wherein the flange of the moveable cartridge extends outward from the closed end of the moveable cartridge to contact and seal with the interior of the can;

a compression wall disposed within the interior of the moveable cartridge between the first piston and the closed end of the moveable cartridge, wherein the compression wall and the moveable cartridge define a second fluid chamber for a second fluid;

a propellant disposed within the can between the sealed end of the can and the flange of the moveable cartridge; and a valve attached to the opening of the can.

9. The propellant actuated fluid cartridge of claim 8, wherein the valve is triggered actuated.

10. The propellant actuated fluid cartridge of claim 8, wherein the valve is spring actuated.

11. The propellant actuated fluid cartridge of claim 8, further comprising a mixer attached to the valve.

12. The propellant actuated fluid cartridge of claim 8, further comprising a valve and mixer attachment attached to the valve, wherein the valve and mixer attachment includes a valve interface, a mixer and a mixer housing and the mixer housing and the mixer are detachable from the valve interface.

13. The propellant actuated fluid cartridge of claim 8, wherein the delivery tube is formed integral with the compression wall.

14. A method for assembling a propellant actuated fluid cartridge for storing and dispensing two fluids, comprising;

providing a can having an opening at one end and a hole for sealing at the other end, providing a fluid cartridge assembly which includes a stationary cartridge, a delivery tube, a first piston, a moveable cartridge and a compression wall, wherein the delivery tube is disposed within the stationary cartridge, the first piston is disposed between the interior of the stationary cartridge and the exterior of the delivery tube forming a fluid chamber for a first fluid, the moveable cartridge is disposed within the stationary cartridge and has a sidewall, wherein the moveable cartridge sidewall is connected to the first piston and has at least one passageway formed therein, and the compression wall is disposed within the interior of the moveable cartridge, wherein the compression wall and the moveable cartridge define a second fluid chamber for a second fluid;

inserting the fluid cartridge assembly into the can through the opening;

crimping the can at the opening and attaching a cup having an opening to contain the fluid cartridge assembly;

through the hole for sealing in the can, pushing the fluid cartridge assembly into the opening in the cup;

crimping the cup to engage the fluid cartridge assembly and fix the fluid cartridge assembly in place;

filling the fluid cartridge assembly with two fluids;

installing a valve on the opening in the cup;

filling the can with propellant through the hole in the can; and placing a rubber plug in the hole to seal the propellant in the can.

15. The method for assembling a propellant actuated fluid cartridge of claim 14, wherein a rod is pushed through the hole in the can to push the fluid cartridge assembly into the opening in the cup.

16. The method for assembling a propellant actuated fluid cartridge of claim 14, wherein air pressure, applied through the hole in the can, is used to push the fluid cartridge assembly into the opening in the cup.

* * * * *